US005290002A

United States Patent [19]

Cohen

[11] Patent Number: 5,290,002

[45] Date of Patent: Mar. 1, 1994

[54] ADJUSTABLE READING AND WRITING AID SYSTEM

[76] Inventor: Dell P. Cohen, 3903 Seven Mile La., Terrace Apt, Baltimore, Md. 21208

[21] Appl. No.: 953,214

[22] Filed: Sep. 30, 1992

[51] Int. Cl.[5] ..... A47G 1/24

[52] U.S. Cl. ..... 248/456

[58] Field of Search ..... 248/456, 460, 441.1, 248/461, 463; 217/15

[56] References Cited

U.S. PATENT DOCUMENTS

| | | | |
|---|---|---|---|
| 578,325 | 3/1897 | Fleming | 248/456 |
| 2,374,409 | 4/1945 | Brennan | 248/456 X |
| 5,112,020 | 5/1992 | Ginsberg | 248/456 |

*Primary Examiner*—Douglas D. Watts

*Attorney, Agent, or Firm*—Morton J. Rosenberg; David I. Klein

[57] ABSTRACT

An adjustable reading and writing aid system (10) is provided which is primarily to be used for mounting on a table top, desk top, or other base surface (12). The adjustable reading and writing aid system (10) includes a first planar member which is mounted on the base surface (12) and further includes a second planar member (18) which may be angularly adjusted at selective angles (32) to provide an optimized position for the user to write on a piece of paper or read book (58) mounted on a frontal surface (62) of the second planar member (18). An adjusting mechanism (34) is rotatably mounted to a rear surface (26) of second planar member (18) and is insertable within notches (54 and 56) formed on opposing transverse sides of first planar member (14) to provide stabilization in selective angular orientations between second planar member (18) and first planar member (14). Adjustable mechanism (34) may be rotated to a sandwiched position between first and second planar members (14 and 18) to allow compactness of an overall housing for transport and storage of the adjustable reading and writing aid system (10).

19 Claims, 3 Drawing Sheets

ADJUSTABLE READING AND WRITING AID SYSTEM

BACKGROUND OF THE INVENTION

1. Field of the Invention

This invention relates to a combined reading and writing aid system which is primarily mounted on a table top or a desk base surface. The adjustable reading and writing aid system allows the user to optimize his or her writing or reading orientation and generally reduces tension created on the user's body by providing a relaxed and balanced posture orientation of the user during operation and use of the adjustable reading and writing aid system. In particular, the adjustable system of the subject invention concept allows for angularly positioning a planar member upon which a writing pad, paper, book or other workpiece is mounted, and provides a stabilized positioning of the planar member during the reading or writing function. Further, this invention relates to an adjustable system which allows for selectively positioning the angular orientation of the workpiece being used at the discretion and comfort of the user. More in particular, this invention relates to an adjustable reading and writing aid system which is completely foldable and allows for an overall minimization of volume dimensions when not in use to allow for storage or ease of transportability. Additionally, the foldability of the aid system allows the system to be left on the base surface subsequent to use in a folded manner. Still further, this invention directs itself to an adjustable reading and writing aid system which includes an adjusting mechanism mounted to a rear surface of a planar member and is rotatable with respect thereto to allow sandwiching of the angular adjustment mechanism between a first and second planar member. Still further, this invention relates to an adjustable reading and writing aid system which includes a handle section allowing easy transportability of the overall system when not in use. Still further, this invention relates to an adjustable reading and writing aid system which includes a positioning bar mountable on a frontal surface of an inclined planar member to allow paper, pads, books, or other workpieces to be further positionally located at the comfort level of the user. Further, the positioning bar member may be stored internal to the writing aid system when not in use and maintained in removable fashion therein. Additionally, the subject system provides leg, foot or lug members fixedly mounted thereto to abut or catch the edge of the base surface being worked upon. In this manner the aid system is substantially positionally stabilized during operational use and may be simply and quickly removed from the base surface subsequent to use.

2. Prior Art

Reading and writing aid systems for use in maintaining paper, pads, or books at predetermined positional orientations are known in the art. The best prior art known to Applicant includes U.S. Pat. Nos. 3,172,636; 4,852,909; 3,821,936; 3,172,636; 905,836; 2,826,857; 2,476,620; 2,640,747; 3,376,009; 3,381,928; 4,522,364; 3,980,266; 2,530,605, and 5,035,393.

In some of such prior art systems such as that shown in U.S. Pat. No. 3,381,928, there is provided a bookrest which includes a pair of planar sections which may be rotated with respect to each other, however, such includes ledges which increase the overall thickness of the system when not in use. Additionally, such do not provide for a positioning or mounting mechanism as in the inventive concept system for attachment to one of the planar members for further positioning of the workpiece, book, or sheets of paper being used. Additionally, such systems do not provide for ease of transportability as provided by the subject invention concept system. Other types of prior art systems such as that shown in U.S. Pat. No. 3,172,636 provide for a portable desk which does include a handle section, but such does not provide for the angular adjustability as provided in the subject system to allow optimization of the orientation of the workpiece with respect to the user.

Additionally, prior art systems such as those shown in U.S. Pat. No. 5,035,393 in general do not provide for system positional stabilization members which abut the table, desk or base surface edge to provide a releasable stabilization positioning of the system in accordance with the invention concept of the subject reading and writing aid system.

SUMMARY OF THE INVENTION

An adjustable reading and writing aid system is provided which includes a first planar member for mounting such on a base surface. The first planar member defines a first planar member edge section extending in a transverse direction. A second planar member includes a second planar member edge section extending in a transverse direction with the first and second planar members being fixedly and rotatably coupled to each other. The first and second planar members are rotatably coupled to each other at respective edge sections of each of the first and second planar members. There is further provided a mechanism for angularly adjusting the first and second planar members in a selective and releasably coupled position with respect to each other. The mechanism for angular adjustment is rotatably secured to a rear surface of the second planar member for inclining the first and second planar members at a predetermined angle, each with respect to the other, when the reading and writing aid is in use and further for a rotation to a position where the mechanism for angular adjustment is sandwiched between the first and second planar members defining a substantially planar and compact housing for storage of the system.

DESCRIPTION OF THE PREFERRED EMBODIMENTS

Figure 1:
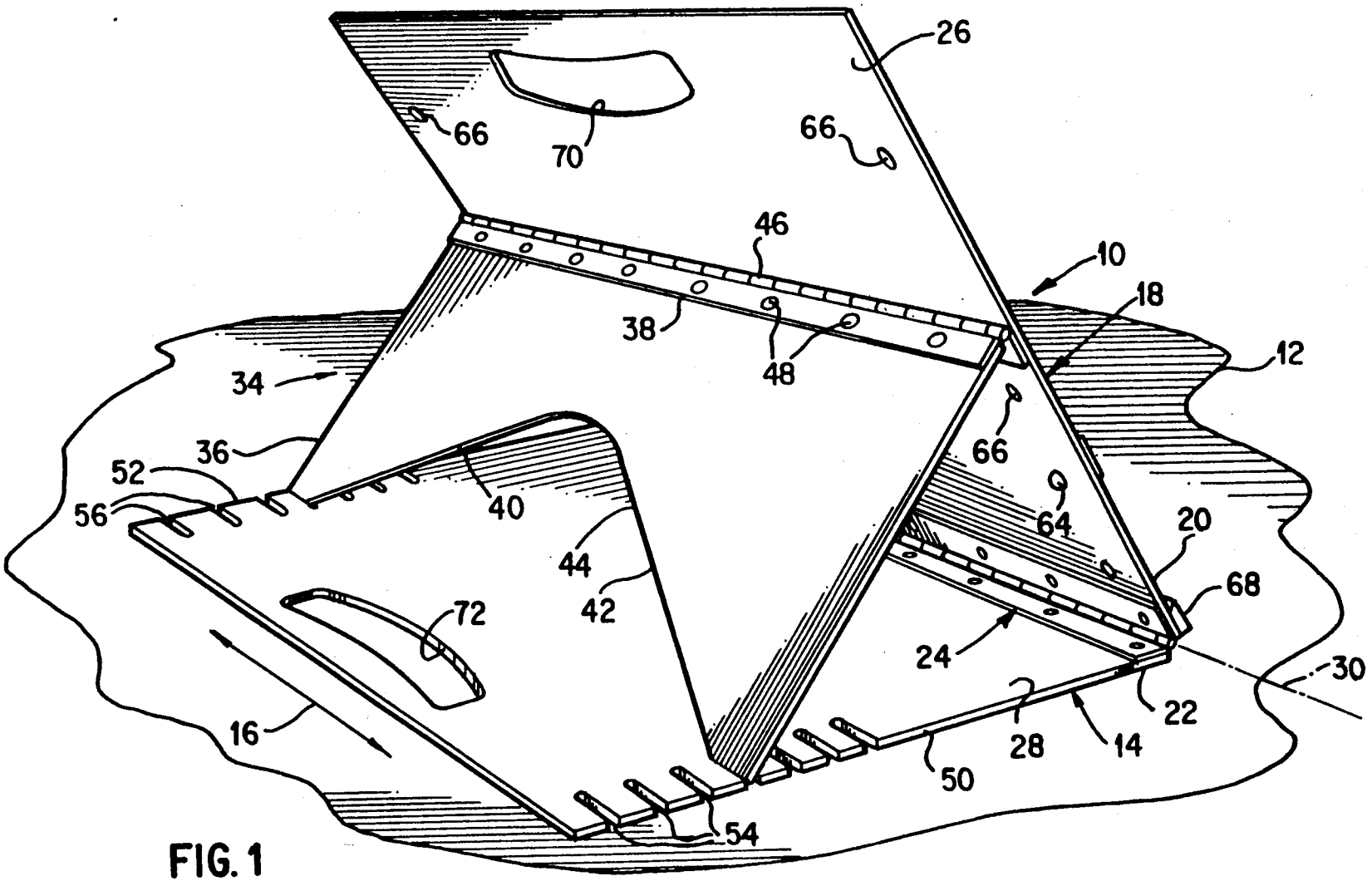
FIG. 1 is a perspective view of the adjustable reading and writing aid system mounted on a base surface.

Referring now to FIGS. 1-5, there is shown adjustable reading and writing aid system 10 which may be positionally located on a plurality of base surfaces 12 at the discretion of a user. Adjustable reading and writing aid system 10 may be used as a lap top desk, or alternatively, may be mounted on a desk surface to aid a user in positioning himself or herself into a comfortable reading or writing surface orientation. The reading and writing aid system 10 compensates for differing person chair orientations as well as compensating for a wide variety of person postures when they are seated adjacent a desk surface to maximize the comfort of the person using system 10. In this manner, the user has an adjustable reading and writing aid system 10 which is portable in nature, may be carried from one location to another, and is collapsible and foldable to a minimal volume dimension allowing for ease of storage or for being collapsed onto base surface 12 in a minimal volume. Of importance is that adjustable reading and writing aid system 10 may be collapsed to a substantially planar housing package which has minimal dimensional depth for ease of storage of adjustable system 10 between uses. Additionally, when it is desired to be used, adjustable writing aid system 10 may be opened as shown in FIG. 1 to provide a plurality of writing or reading positional orientations for the user at the user's discretion.

Additionally, as will be discussed in following paragraphs, system 10 includes a means whereby the entire system 10 may be stabilized against a desk surface to maintain a releasably fixed position during use.

Adjustable reading and writing aid system 10 includes first substantially planar member 14 which extends in transverse direction 16 providing an outer envelope contour in the form of a rectangle or square, however, the specific envelope contour is not important to the inventive concept, with the exception that first planar member 14 have a sufficient contour to provide a stabilized base mounting for positioning of adjustable reading and writing aid system 10 on base surface 12. First planar member 14 may be formed of a plastic material, fibrous composition, or metal, not important to the inventive concept as herein detailed, with the exception that the material composition of first planar member 14 be of sufficient structural integrity to accept the applied forces during use.

Figure 3:
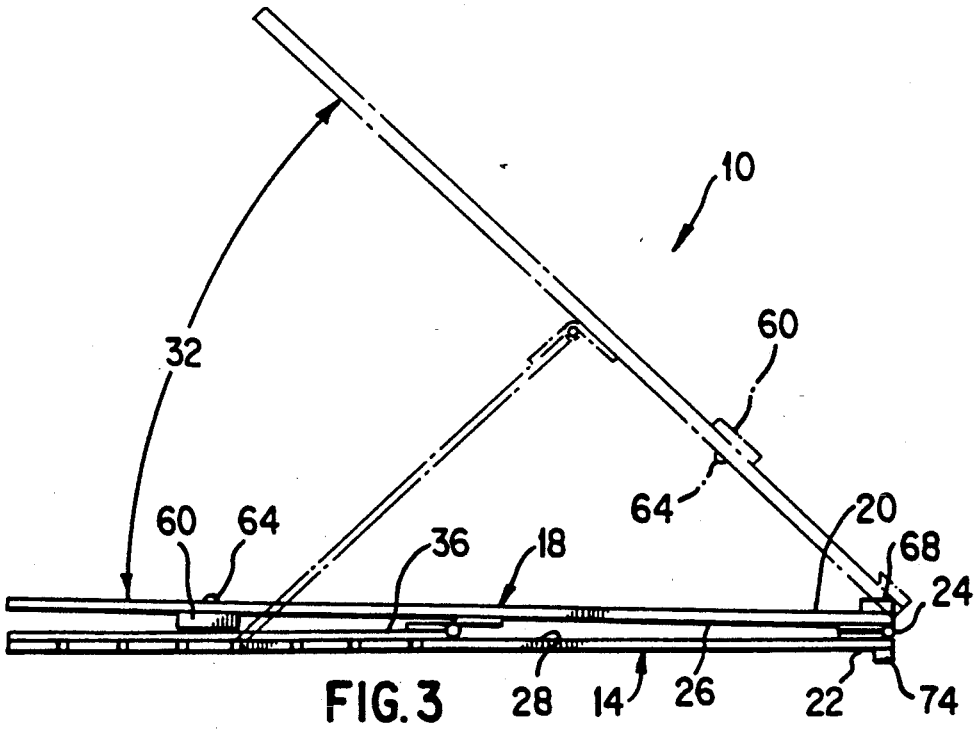
FIG. 3 is a side elevational view of the adjustable reading and writing aid system showing such in a closed condition and in phantom line drawings in an open orientation.

As shown in FIGS. 1 and 3, adjustable reading and writing aid system 10 includes second planar member 18 having second planar member edge section 20 which lies adjacent to and is rotatable with respect to first planar member edge section 22 clearly shown in FIG. 1. As will be detailed in following paragraphs, first and second planar members 18 and 14 are fixedly and rotatably coupled each to the other in the area of edge sections 20 and 22.

First hinge mechanism 24 is secured to rear surface 26 of second planar member 18 and further secured to rear surface 28 of first planar member 14, as is clearly seen in FIG. 1. Hinge mechanism 24 is positionally located adjacent edge sections 20 and 22, as is seen in both FIGS. 1 and 3. Additionally, first hinge mechanism 24 extends in transverse direction 16 throughout a transverse extended length of edge sections 20 and 22 to provide an extended apex line for first and second planar members 14 and 18. In this manner, first and second planar members 14 and 18 are rotatable about first hinge axis line 30 to allow differing angles between first and second planar members 14 and 18, as provided by arcuate arrow 32 shown in FIG. 3.

Second planar member 18 includes a substantially rectangular or square contour and in a preferred contour, is congruent to the contour of first planar member 14. In this manner, first and second planar members 14 and 18 may be collapsed or folded, as shown in FIG. 3, to provide a compact housing when adjustable reading and writing aid system 10 is not in use. In this manner, first hinge mechanism 24 having hinge axis 30 adjacent respective ends 20 and 22 of first and second planar members 14 and 18 allows rotation of first and second planar members 14 and 18 in an aligned relation each to the other throughout a wide variety of arcuate angles, as shown in FIG. 3.

Adjustable system 10 further includes angular adjustment mechanism 34 for adjusting first and second planar members 14 and 18 in a selected and releasably coupled position each to the other. Angular adjustment mechanism 34 is rotatably secured to rear surface 26 of second planar member 18 for inclining second planar member 18 in a predetermined manner with respect to first planar member 14, as is seen in FIG. 1. In this manner, second planar member 18 is mounted at a predetermined angle to first planar member 14 when adjustable reading and writing aid system 10 is in use and allows for a rotational actuation or displacement to a position where angular adjustment mechanism 34 is sandwiched between first and second planar members 14 and 18, as shown in FIG. 3 to define a substantially planar and compact overall housing for storage of adjustable writing aid system 10 when not in use or when simply mounted on base surface 12 in a flattened or closed condition.

Angular adjustment mechanism 34 includes third substantially planar member 36 which is clearly seen to be rotatably secured to rear surface 26 of second planar member 18. Third planar member 36 is substantially U-shaped in contour having base section edge 38 and a pair of opposing arm members 40 and 42. Opposing arm members 40 and 42 define an arcuate cut-out 44 of third planar member 36 for purposes to be described in later paragraphs. Third planar member 36 may be formed of a plastic material composition, fibrous material, or metal, not important to the inventive concept as herein described, with the exception that such be able to accept the loads applied during use of adjustable reading and writing aid system 10.

Base section edge 38 of third planar member 36 is rotationally coupled to rear surface 26 of second planar member 18 by attachment to second hinge mechanism 46 which extends in a transverse direction throughout the transverse length of second planar member 18, as shown in FIG. 1. Second hinge mechanism 46 is of standard commercially available type hinging mechanisms and is fixedly secured to base section edge 38 of third planar member 36 through bolts, screws, or like elements 48. In this manner, third planar member 36 may be rotated into contiguous or adjacent vicinities with respect to second planar member 18 and/or first planar member 14, as further shown in FIG. 3.

Second hinge mechanism 46 extends in transverse direction 16 across rear surface 26 of second planar member 18, and is positionally located approximately one-half the extended length of second planar member 18 in a direction substantially normal or perpendicular to transverse direction 16. In this manner, angular adjustment mechanism 34 is given a stabilization to the entire system to allow applied loads to be accepted by adjustable reading and writing aid system 10 in an optimizing fashion.

First planar member 14 includes opposing transverse edges 50 and 52. Opposing edges 50 and 52 include a first set of notches 54 formed in first transverse edge 50 and a second set of notches 56 formed in second transverse edge 52. Notches 54 and 56 extend partially internal the contour of first planar member 14 and are sized to allow insert of third planar member arms 40 and 42, as shown. First and second sets of notches 54 and 56 include individual notch members which are aligned in transverse direction 16 in order to allow insert of third planar arm members 40 and 42 in a manner to allow third planar member 36 to be maintained in a substantially planar member when in a mounted and positioned condition, as shown in FIG. 1. With the insert of the end portions of arm members 40 and 42 into selective notches of first and second sets 54 and 56, second planar member 18 may be selectively oriented in an angular fashion to first planar member 14 to provide an optimized angular orientation for a user when working with a workpiece 58, which may be a sheet of paper or a book.

Figure 2:
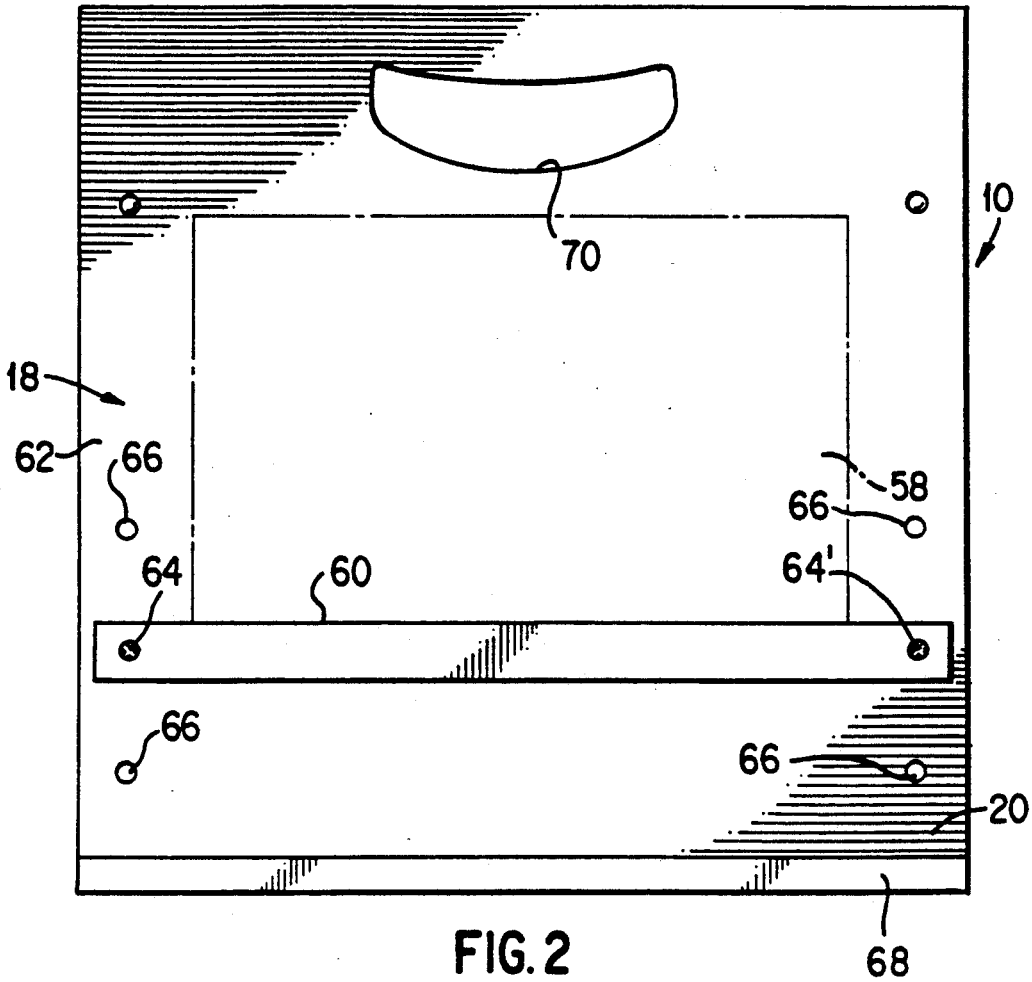
FIG. 2 is a frontal elevation view of the reading and writing aid system.
Figure 4:
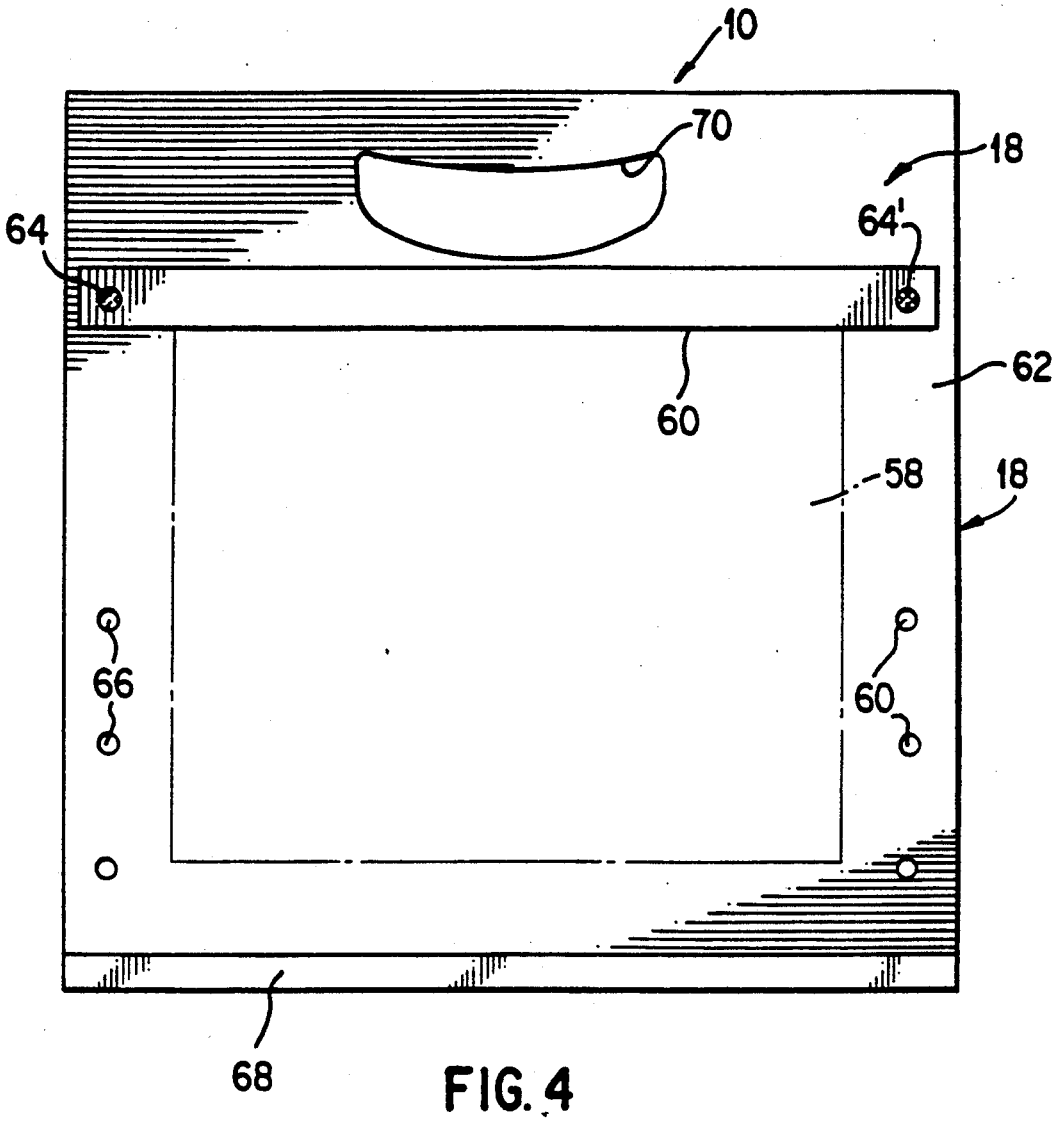
FIG. 4 is a frontal elevational view of the adjustable reading and writing aid system showing mounting of a workpiece, paper, or book in a particular orientation position; and, FIG. 5 is a front elevational view of the adjustable reading and writing aid system in the closed condition.

Particular positioning and orientation of a sheet of paper, book or workpiece 58, as shown in FIG. 2, onto adjustable reading and writing aid system 10 is further optimized by allowing for a selective positioning of book or paper 58 to frontal surface 62 of second planar member 18. Positioning bar member 60 is removably securable to second planar member 18 and extends substantially linearly in transverse direction 16, as is shown in FIG. 2. Positioning bar member 60 may be formed of similar material to that of first and second planar members 14 and 18 and is clearly seen to be used as a positioning mechanism for workpiece, book, or paper 58. Positioning bar member 60 includes a pair of lug members 64, 64' extending from a lower surface of positioning bar member 60 and located at opposing transverse ends for removable insert into selective through openings 66 formed through second planar member 18 for mounting positioning bar 60 thereon, as is shown in FIGS. 2 and 4. Lug members 64, 64' are sized for force-fit into through openings 66 to provide a stabilized mounting for paper, book or workpiece 58 mounted on positioning bar member 60, as is shown. In this manner, positioning bar member 60 is releasably mounted on second planar member 18 and adjacent second planar member frontal surface 62.

In general, positioning bar 60 is used for prepositioning any workpiece 58 on second planar member 18. However, specifically positioning bar 60 is of maximum use as a location bar for workpiece 58 when workpiece 58 is a book being read. Bar 60 location may be varied by insert of lugs 64 and 64' into predetermined locating openings 66 which position the book at an optimized height on member 18 with relation to a user's comfort.

As can be seen in FIG. 3, positioning bar member 60 may be mounted adjacent rear surface 26 of second planar member 18 when adjustable reading and writing aid system 10 is being transported or is being stored subsequent to operational use. Adjustable system 10 further includes lower ledge 68 secured to edge section 20 of second planar member 18, as shown in FIGS. 1–3. In this manner, workpiece 58 may be mounted directly on ledge 68 which extends external frontal surface 62 to provide a positioning area for workpiece 58, or alternatively, to provide a rest for writing utensils. Ledge member 68 is fixedly secured to edge section 20 and extends in transverse direction 16 throughout the transverse length of second planar member 18. Ledge member 68 may be formed of a plastic composition and fixedly secured through adhesives, bolting, or other fixed securement mechanisms, not important to the inventive concept as herein described.

In order to provide an overall compact system utilizing a minimal volume dimensional space when folded, hand hold openings 70 and 72 are provided in respective second planar member 18 and first planar member 14, as is shown. Openings 70 and 72 are substantially formed in congruent overall contour and aligned each to the other for allowing a user's hand to pass through both openings 70 and 72 and carry adjustable reading and writing aid system 10 in an efficient manner.

When being transported, adjustable reading and writing aid system 10 is folded as is shown in solid line drawings of FIG. 3 to provide a compact system wherein adjustable mechanism 34 is sandwiched between first and second planar members 14 and 18 in a compact volume efficient manner. Upon use, second planar member 18 is angularly moved through a predetermined angle 32 and the end sections of arms 40 and 42 of third planar member 36 are inserted in aligned notches 54 and 56, as shown in FIG. 1 to provide a stabilizing frontal surface 62 upon which workpiece, book, or paper 58 may be mounted.

As shown in FIG. 4, positioning bar 60 may be mounted adjacent openings 70 to allow capturing of workpiece or paper 58 between positioning bar 60 and frontal surface 62 of second planar member 18. FIG. 4 allows for a slightly different configuration and shows the variational capacity of adjustable reading and writing aid system 10 to accommodate a wide range of positioning for workpiece, book or paper 58.

Figure 5:
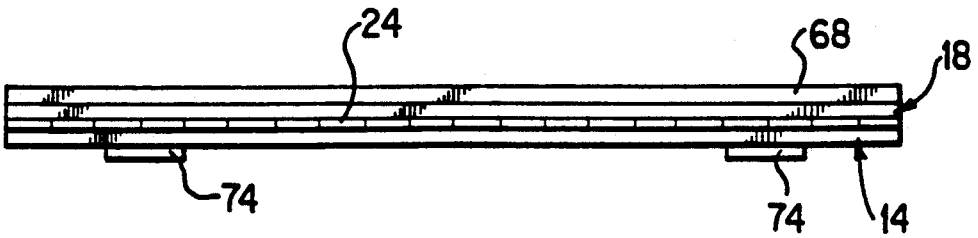

Referring now to FIG. 5, there is shown a pair of foot or lug members 74 mounted to a lower surface of first planar member 14. Foot members 74 are displaced from each other in transverse direction 16 and are generally although not necessarily inset from the opposing sides of first planar member 14. As can be seen, foot members 74 have a thickness dimension which allows them to releasably abut the edge of a desk or table to positionally stabilize system 10 during operational use. In this manner system 10 is positionally constrained from movement during use. Foot members 74 may be adhesively attached to planar member 14 or bolted thereto in a manner not important to the inventive concept as herein described. As in the case of first planar member 14, foot members 74 may be formed of plastic material, fibrous composition or metal, not important to the inventive concept.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended Claims.

What is claimed is:

1. An adjustable reading and writing aid system comprising:

(a) a first planar member for mounting on a base surface, said first planar member defining a first planar member edge section;

(b) a second planar member having a second planar member edge section, said first and second planar members being fixedly and rotatably coupled each to the other, said first and second planar members being rotatably coupled to each other at respective edge sections thereof;

(c) means for angularly adjusting said first and second planar members in a selective and releasably coupled position each to the other, said means for angular adjustment being rotatably secured to a rear surface of said second planar member for inclining said first and second planar members at a predetermined angle each with respect to the other when said writing aid is in use and for rotation to a position where said means for angular adjustment is sandwiched between said first and second planar members defining a substantially planar and compact housing for storage of said reading and writing aid system; and, (d) means for selectively positioning a workpiece to a frontal surface of said second planar member at a predetermined distance measured substantially normal said transverse direction, said means for selectively positioning said workpiece including a positioning bar removably securable to said second planar member and extending substantially linearly in said transverse direction.

2. The reading and writing aid system as recited in claim 1 including first hinge means secured to said rear surface of said second planar member and a rear surface of said first planar member, said first hinge means being located adjacent respective edge sections of said first and second planar members.

3. The reading and writing aid system as recited in claim 2 where said first hinge means extends substantially throughout a transverse extended length of said edge sections of said first and second planar member.

4. The reading and writing aid system as recited in claim 2 where said first hinge means defines a first hinge axis adjacent respective end sections of said first and second planar members for rotation of said first and second planar members in aligned relation each to the other.

5. The reading and writing aid system as recited in claim 2 where said first and second planar members define substantially congruent contours.

6. The reading and writing aid system as recited in claim 1 where said means for angular adjustment includes a third substantially planar member rotatably secured to said rear surface of said second substantially planar member.

7. The reading and writing aid system as recited in claim 6 where said third substantially planar member is substantially U-shaped in contour having a base section edge and a pair of opposing arm members.

8. The reading and writing aid system as recited in claim 7 where said base section edge of said third substantially planar member is rotationally coupled to said rear surface of said second planar member.

9. The reading and writing aid system as recited in claim 8 including second hinge means secured to said rear surface of said second planar member and said base section edge for rotation of said third substantially planar member with respect to said second planar member.

10. The reading and writing aid system as recited in claim 9 where said second hinge means extends substantially throughout a transverse extension length of said second planar member.

11. The reading and writing aid system as recited in claim 10 where said second hinge means is fixedly mounted to said second planar member approximately one-half the extended length of said second planar member in a direction substantially normal said transverse direction.

12. The reading and writing aid system as recited in claim 11 where said first planar member includes a plurality of notches formed through at least one transverse edge thereof for insert of one of said arm members of said third substantially planar member.

13. The reading and writing aid system as recited in claim 11 where said first planar member includes a first set of notches formed in a first transverse end of said first planar member and a second set of notches formed in a second transverse end of said planar member, said notches forming said first and second set being aligned each to the other for insert of said opposing arm members of said third substantially planar member.

14. The reading and writing aid system as recited in claim 1 where said positioning bar includes a pair of lug members extending from one surface thereof and located at opposing transverse ends of said positioning bar for removable insert into selective through openings formed through said second planar member for mounting said positioning bar thereto.

15. The reading and writing aid system as recited in claim 14 where said positioning bar lug members are insertable through said through openings for releasably mounting said positioning bar adjacent said rear surface of said second planar member for storage thereof.

16. The reading and writing aid system as recited in claim 1 including a ledge member secured to said second planar member at a lower end thereof and extending in said transverse direction for mounting a workpiece thereon.

17. The reading and writing aid system as recited in claim 1 including means for positionally stabilizing said reading and writing aid system to said base surface, said positional stabilization means including a pair of foot members secured to a lower surface of said first planar member for abutting an edge of said base surface.

18. An adjustable reading and writing aid system comprising:

(a) a first planar member for mounting on a base surface, said first planar member defining a first planar member edge section;

(b) a second planar member having a second planar member edge section, said first and second planar members being fixedly and rotatably coupled each to the other, said first and second planar members being rotatably coupled to each other at respective edge sections thereof;

(c) means for angularly adjusting said first and second planar members in a selective and releasably coupled position each to the other, said means for angular adjustment being rotatably secured to a rear surface of said second planar member for inclining said first and second planar members at a predetermined angle each with respect to the other when said writing aid is in use and for rotation to a position where said means for angular adjustment is sandwiched between said first and second planar members defining a substantially planar and compact housing for storage of said reading and writing aid system; and, (d) a pair of handle members defined by a pair of hand openings adapted for insert of a user's hand formed through an upper section of said first and second planar members.

19. The reading and writing aid system as recited in claim 18 where said pair of hand openings are aligned each with respect to the other when said first and second planar members are rotated to a position adjacent each other.

* * * * *